United States Patent [19]

Schaad

[11] 4,053,726

[45] Oct. 11, 1977

[54] PUSH-BUTTON ELECTRICAL SWITCH

[75] Inventor: William J. Schaad, Winnetka, Ill.

[73] Assignee: Indak Manufacturing Corporation, Northbrook, Ill.

[21] Appl. No.: 660,920

[22] Filed: Feb. 24, 1976

[51] Int. Cl.[2] ..... H01H 9/04

[52] U.S. Cl. ..... 200/159 R

[58] Field of Search ..... 200/159 R, 159 B, 83 N, 200/83 B, 153 V

[56] References Cited

U.S. PATENT DOCUMENTS

| | | | |
|---|---|---|---|
| 3,586,810 | 6/1971 | Brown | 200/159 R |
| 3,676,626 | 7/1972 | Mitchell | 200/159 R |

*Primary Examiner*—Herman T. Hohauser

*Attorney, Agent, or Firm*—Burmeister, York, Palmatier, Hamby & Jones

[57] ABSTRACT

The illustrated switch comprises a casing, a push-button movable in the casing along a predetermined axis, fixed contact means disposed in the casing opposite the push-button and generally along such axis, an insulating carriage disc disposed in the casing and along the axis at an intermediate point between the push-button and the fixed contact means, the disc being movable toward and away from the fixed contact means, movable contact means mounted on the disc and movable therewith into and out of engagement with the fixed contact means for establishing and breaking an electrical circuit, a first compression spring disposed in the casing between the casing and the disc for biasing the disc and the movable contact means away from the fixed contact means, and a second compression spring disposed between the push-button and the disc for overcoming the strength of the first compression spring and moving the disc to bring the movable contact means into engagement with the fixed contact means when the push-button is moved toward the disc. The push-button is slidable in an opening in the casing toward the disc and into a position in which the push-button is flush with the casing. In this way, the force on the fixed contact means cannot exceed the force developed by the resilience of the springs, so that there is no possibility of damaging the switch by applying excessive force to the push-button. There is no possibility, for example, of pushing the fixed contact means out of the rear end of the casing.

3 Claims, 6 Drawing Figures

FIG. 1
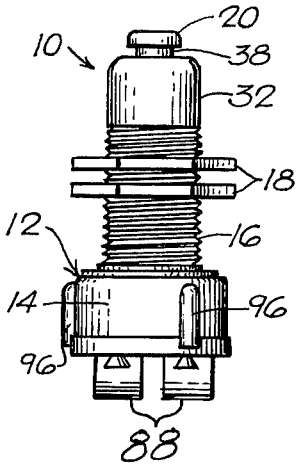
FIG. 2
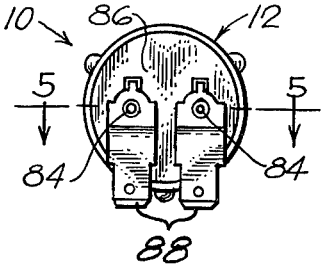
FIG. 3
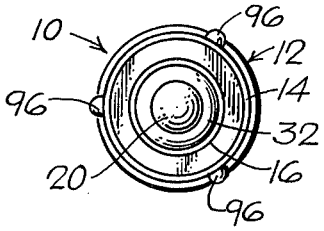
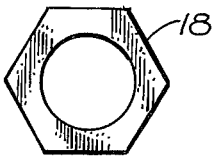
FIG. 4
FIG. 5
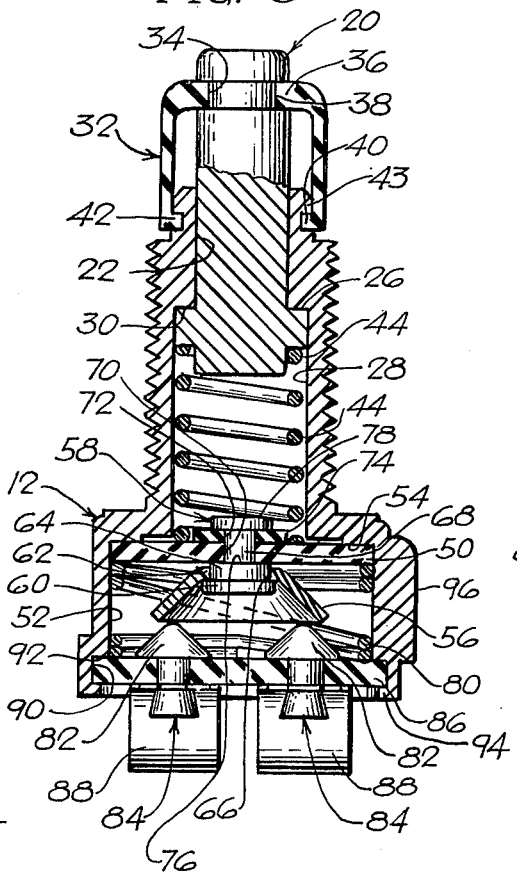
FIG. 6
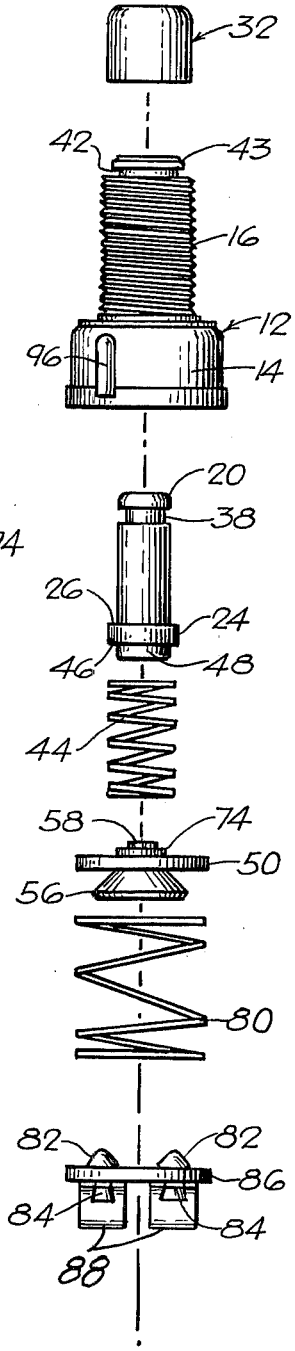

PUSH-BUTTON ELECTRICAL SWITCH

This invention relates to a new and improved push-button electrical switch. In certain aspects, this invention may be regarded as an improvement upon the heavy duty push-button electrical switch disclosed and claimed in the applicant's copending patent application, Ser. No. 469,056, filed May 13, 1974.

One object of the present invention is to provide a new and improved push-button electrical switch in which a spring is provided between the push-button and a movable carriage which carries a contactor, adapted to be moved into engagement with fixed contact means, the spring being the sole connection between the push-button and the carriage, so that the push-button can have a considerably greater range of movement than the range of movement of the carriage.

A further object is to provide such a new and improved push-button switch in which the push-button is movable in an opening formed in a casing, between an initial position, in which the push-button projects out of the casing, and a fully operated position, in which the push-button is flush with the casing. In this way, the push-button never engages any obstruction or stop within the casing, so that the internal mechanism of the switch cannot be damaged by applying excessive force to the push-button.

A further object is to provide a new and improved push-button switch of the foregoing character which is easy to assemble, low in cost, and surprisingly simple in construction.

To accomplish these and other objects, the push-button switch of the present invention preferably comprises a casing, a push member movable in the casing in a predetermined direction, fixed contact means disposed in the casing opposite the push-button, and insulating carriage member disposed in the casing at an intermediate point between the push member and the fixed contact means, the carriage member being movable toward and away from the fixed contact means, movable contact means mounted on one side of the carriage member and movable therewith into and out of engagement with the fixed contact means for establishing and breaking an electrical circuit, a first compression spring disposed in the casing between the casing and such one side of the carriage member for biasing the carriage member and the movable contact means away from the fixed contact means, and a second compression spring disposed between the push member and the opposite side of the carriage member for overcoming the strength of the first compression spring and moving the carriage member to bring the movable contact means into engagement with the fixed contact means when the push member is moved toward the carriage member.

The insulating carriage member preferably takes the form of an insulating disc which is movable in the casing. The switch may include first stop means, such as a shoulder within the casing, for limiting movement of the carriage member away from the fixed contact means to maintain the first compression spring under initial compression. The switch may also include second stop means, such as interengageable shoulders on the push member and the casing, for limiting movement of the push member in the casing away from the carriage member to maintain the second compression spring under initial compression.

When the push-button is operated, it can be pushed inwardly until it is flush with the casing, without engaging the carriage or any other element within the casing. Such movement of the push-button compresses the second spring, which moves the carriage against the strength of the first spring, until the movable contact means come into engagement with the fixed contact means. Additional movement of the push-button merely compresses the second spring. The force applied to the carriage is limited to the resilient force developed by the second spring, so that it is impossible to damage the internal mechanism of the switch by applying excessive force to the push-button. For example, there is no possibility of pushing the fixed contact means out of the rear end of the casing. This characteristic is particularly advantageous when the push-button is operated mechanically, as by a cam, lever or the like. Thus, the switch is highly advantageous for use as a neutral safety switch in connection with the transmission of an automotive vehicle. For such service, the switch is generally operated by a cam or some other element in the control mechanism of the transmission.

Further objects, advantages and features of the present invention will appear from the following description, taken with the accompanying drawings, in which:

FIG. 1 is a side view of a push-button switch to be described as an illustrative embodiment of the present invention.

FIG. 2 is a rear view of the push-button switch of FIG. 1.

FIG. 3 is a front view of the push-button switch of FIG. 1.

FIG. 4 is an end view of a mounting nut for the push-button switch of FIG. 1.

FIG. 5 is an enlarged longitudinal section, taken generally along the line 5—5 in FIG. 2.

FIG. 6 is an exploded side view showing the disassembled parts of the switch.

As just indicated, the drawings illustrate a push-button switch 10 which will find many applications, but is expecially advantageous for use on automotive vehicles, such as automobiles, trucks, farm tractors and the like. The push-button switch may be used for example, as a starter switch or a neutral safety switch.

It will be understood that the switch 10 may be operated manually, but the switch is particularly advantageous for situations in which it is to be operated mechanically, by a cam, lever, link or the like.

As shown, the push-button switch 10 comprises a casing or body 12, which may be made of metal or any other suitable material, such as a resinous plastic material. The illustrated casing 12 has a generally cylindrical rear portion 14 and a reduced generally cylindrical front portion or stem 16. Preferably, the stem 16 is externally threaded for mounting purposes. One or more clamping nuts 18 may be mounted on the threaded stem 16. The threaded stem 16 and the mounting nuts make it easy to adjust the position of the switch, which is an important feature in a neutral safety swtich.

The illustrated switch 10 has a push-button 20 which is movably mounted in the casing 12. As shown, the push-button 20 is in the form of a generally cylindrical plunger or member which initially projects forwardly from the threaded stem 16 and is slidably received in a bore or opening 22, formed axially in the stem 16. The push-button 20 is adapted to be pressed rearwardly into the casing 12 to operate the switch 10.

The switch 10 preferably includes stop means for limiting the forward movement of the push-button 20, so that the push-button will be retained in the casing 12. As shown, the push-button 20 is formed with an enlarged annular portion 24, located near the rear end of the push-button. The enlarged portion 24 provides a forwardly facing shoulder 26.

The stem portion 16 of the casing 12 is preferably formed with an enlarged bore or opening 28, in which the enlarged portion 24 of the push-button 20 is movable. The bore 28 is disposed to the rear of the bore 22, so that a rearwardly facing shoulder 30 is formed in the casing, to act as a stop for the shoulder 26 on the push-button 20.

It will be understood that the push-button 20 may be made of metal or any other suitable material, such as a resinous plastic material.

It is preferred to provide a sealing boot 32 between the push-button 20 and the stem portion 16 of the casing 12. The boot 32 may be made of natural or synthetic rubber, or some other flexible resilient material. The illustrated boot 32 is generally cup-shaped in form and is provided with an opening 34 for receiving the push-button 20. The boot 32 has a front sealing flange 36 which fits snugly into a groove 38 formed in the front end of the push-button 20. The rear end of the boot 32 is formed with an inwardly projecting flange 40 which forms a seal with an annular groove 42, formed in a reduced front end portion 43 of the stem portion 16. Because of the reduced size of the front end portion 43, the boot 32 can be small enough in its outside diameter to permit the nuts 18 to be slipped over the boot 32, after it has been mounted on the front end portion 43. Thus, the switch 10 can be shipped from the factory with the boot 32 fully installed, without interferring with the installation of the nuts 18 in the field. The boot 32 is so flexible that it does not significantly interfere with the sliding movement of the push-button 20.

The push-button 20 is biased forwardly by a spring 44 which is preferably of the coiled compression type. The spring 44 functions not only as a return spring, but also as the sole means for transmitting forces between the push-button 20 and the other switching components in the casing 12.

Initially, the spring 44 is housed within the enlarged bore 28 in the stem portion 16 of the casing 12. The front end of the compressing coiled spring 44 engages a shoulder 46 which is formed on the rear side of the enlarged portion 24 on the push-button 20. It will be seen that the rear end of the push-button 20 is formed with a cylindrical portion 48 which mates with the spring 44 to keep the spring in axial alignment with the push-button 20. In this case, the cylindrical portion 48 is reduced in size, relative to the enlarged portion 24, so as to fit within the front end of the spring 44.

The rear end of the spring 44 engages a carriage member 50 which advantageously takes the form of a flat circular disc made of insulating material. The carriage disc 50 is movable rearwardly and forwardly in an enlarged bore or opening 52 formed in the rear portion of the casing 12. The opening 52 is preferably cylindrical in shape and is disposed to the rear of the bore 28. Initially, the carriage disc 50 engages a rearwardly facing seat or shoulder 54 on the inside of the casing 12 between the bores 28 and 52. The shoulder 54 acts as a stop to limit the forward movement of the carriage disc 50.

The carriage disc 50 is provided with movable contact means which may advantageously take the form of a generally cup-shaped frusto-conical contactor 56, made of copper or some other highly conductive material. The contactor 56 is mounted axially on the rear side of the carriage disc 50 and is movable therewith. As shown, the contactor 56 is secured to the carriage disc 50 by a shoulder rivet 58, but other fastening means may be employed, if desired. As shown, the rivet 58 has an enlarged head 60 which is disposed to the rear of an end wall portion 62 of the contactor 56. The rivet 58 has a first shank portion 64 which extends through an opening 66 in the end wall 62 of the contactor 56. The shank portion 64 is immediately in front of the head 60.

It will be seen that the rivet 58 has a second shank portion 68 of a smaller diameter than the first shank portion 64. The second shank portion 68 extends through an opening 70 in the carriage disc 50, and also through an opening 72 in a washer 74, disposed in front of the carriage disc 50. The larger shank portion 64 provides a shoulder 76 which engages the rear side of the carriage disc 50.

The rivet 58 has an enlarged, upset end 78, clamping the washer 74 and the carriage disc 50 against shoulder 76 of the rivet. It will be seen that the washer 74 extends within the rear end of the coil spring 44 and functions to center the coil spring relative to the carriage disc 50. The outside diameter of the washer 74 is slightly smaller than the inside diameter of the coil spring 44.

The contactor 56 fits loosely on the first shank portion 64 of the rivet 58, so that the contactor 56 is free to rotate with respect to the carriage disc 50. Moreover, the contactor 56 is free to rock to a limited extent with respect to the carriage disc 50. This freedom of movement enables the contactor 56 to be self-aligning with the fixed contact means, to be described presently.

The washer 74 is preferably made of an insulating material, such as a resinous plastic material, but may be made of other materials. The rivet 58 is preferably made of metal.

The push-button switch 10 comprises resilient means for biasing the carriage disc 50 in a forward direction, toward the shoulder or stop 54. Such resilient means may advantageously take the form of a coiled compression spring 80, mounted in the casing 12 behind the carriage disc 50. The front end of the spring 80 engages the rear side of the carriage disc 50. As shown, the spring 80 is received within the cylindrical opening 52 in the casing 12. The outside diameter of the spring 80 is slightly less than the inside diameter of the opening 52.

The switch 10 is provided with fixed contact means for engagement by the movable contactor 56. Such fixed contact means may advantageously comprise a pair of contact elements 82, mounted in the casing 12, at the opposite end thereof from the push-button 20, and near the axis of the switch, for engagement by the contactor 56. The contact elements 82 are preferably made of copper or some other highly conductive material. As shown, each contact element 82 takes the form of a generally conical head or a rivet 84, extending through an insulating terminal board or wall 86. The ends of the conical contact element or points 82 are smoothly rounded. It will be seen that the frusto-conical inner surface of the contactor 56 is engageable with the conical outer surfaces of the contact points 82, so that the contactor forms a bridge between the contact points, to establish an electrical circuit therebetween. The frusto-conical inner surface of the contactor 56 engages the conical contact points 82 with a wiping action, so that the contacting surfaces are wiped clean due to the normal operation of the switch. There is also a wedging action between the inclined frusto-conical contactor and the conical contact points. Such wedging action amplifies the contact pressure.

The illustrated contact points 82 are mounted on the insulating terminal board 86 at diametrically opposite points, at the same distance from the axis of the switch 10. It would also be possible to provide three equally spaced contact points.

Terminal lugs 88 are secured to the contact rivets 84 and are mounted on the rear side of the insulating terminal board 86. The illustrated terminal lugs are adapted to receive a suitable connector for connecting the switch 10 into an electrical circuit. It will be understood that terminals of other types may be employed, if desired.

The insulating terminal board 86 forms the rear wall of the casing 12. The illustrated terminal board 86 is mounted within a cylindrical opening 90, formed at the rear of the casing 12. The opening 90 connects with the opening 52 and is larger than the opening 52. The terminal board 86 seats against a shoulder 92.

The switch 10 includes suitable means for securing the insulating terminal board 86 to the casing 12. Such means may comprise a flange 94 which is bent or crimped inwardly, behind the insulating terminal board 86.

The rear portion 14 of the casing 12 may be formed with a plurality of outwardly projecting ribs or lugs 96 to assist in gripping and holding the casing when the switch 10 is being installed in an automotive vehicle. The ribs 96 also strengthen the casing.

While the operation of the switch 10 will be clear from the foregoing description, it may be helpful to summarize the operation briefly. Initially, the spring 80 biases the carriage disc 50 forwardly toward the shoulder 54, as shown in FIG. 5. The spring 44 biases the push-button 20 forwardly, so that its forwardly facing shoulder 26 engages the stop shoulder 30 on the casing 12.

When the push-button 20 is pushed rearwardly, the force of the spring 44 overcomes the force of the spring 80, so that the carriage disc 50 is moved rearwardly until the contactor 56 engages the contact points 82. The force of the spring 44 is applied directly to the insulating carriage disc 50. The frusto-conical contactor 56 aligns itself with the conical contact points 82, because the contactor 56 is free to rock to a limited extent on the shank portion 64 of the rivet 58. The carriage disc 50 travels rearwardly until it firmly presses the contactor 56 against the contact points 82. Any additional rearward movement of the push-button 20 merely compresses the spring 44. The force exerted on the push-button 20 is transmitted solely by the sping 44 to the carriage disc 50. The push-button 20 never solidly engages the carriage disc 50 or the rivet 58. In fact, the push-button 20 can be pushed rearwardly until it is flush with the front end of the casing 12, and still the push-button 20 does not engage the rivet 58, nor is the spring compressed to a solid state. Thus, the carriage disc 50 is pushed rearwardly solely by the resilient force of the compression spring 44. For this reason, it is not possible to damage the internal mechanism of the switch by applying an excessive force to the push-button 20. There is no possibility, for example, of damaging the insulating terminal board 86 or pushing the terminal board out of the rear end of the casing 12. Because of this characteristic, the switch 10 is well adapted for mechanical operation by a cam, lever, link or the like.

The outside of the flexible boot 32 is small enough to permit installation and removal of the nuts 18 while the boot 32 is mounted on the switch. Thus, the switch 10 can be shipped from the factory with the boot 32 fully installed, without interferring with the installation of the nuts 18 in the field.

If desired, the switch 10 can be used without the boot 32. However, the boot 32 has the advantage of sealing the switch, so that moisture, dirt and other foreign material will be excluded from the interior of the switch.

When the switch 10 is in its initial position, as shown in FIG. 5, the contactor 56 is free to rotate. Normal vibration will cause slight rotation of the contactor, so that the same portion of the contactor will not always engage the contact points 82. Thus, the wear on the contactor 56 is distributed around the entire frusto-conical contacting surface of the contactor.

The ability of the contactor 56 to rotate arises from the fact that the opening 66 in the contactor is slightly larger than the shank portion 64 on which the contactor is mounted. The ability of the contactor 56 to rock slightly, relative to the rivet 58, also arises from this loose fit and from the fact that the thickness or depth of the shank portion 64 is greater than the thickness of the end wall 62 on the contactor 56.

It will be seen from FIG. 5 that the push-button 20 can be pushed rearwardly until it is flush with the casing 12, without encountering any obstruction within the switch 10. The spring 44 is not solidly compressed by such movement. Normally, of course, the push-button 20 is not pushed rearwardly so far as to disconnect the boot 32 from the push-button, but, with the boot 32 removed from the switch 10, the push-button can be pushed rearwardly until it is flush with the casing 12.

The switch 10 is remarkably small, light in weight and economical in construction. In addition, the switch is resistant to corrosion, dust and moisture, so that it will afford long life, even under severe operating conditions.

I claim:

1. A push-button electrical switch, comprising a casing having an axial generally cylindrical opening therein, a push button movable in said cylindrical opening in an axial direction, said push button having a front portion extending through said opening and out of said casing, said opening having an enlarged axial generally cylindrical rear portion, an insulating carriage disc movable in said enlarged portion in a generally axial direction, said casing having an insulating rear wall disposed to the rear of said carriage disc and closing the rear end of said enlarged portion, said casing having a rearwardly facing annular shoulder at the front end of said enlarged portion, fixed contact means disposed in said enlarged portion and on said insulating rear wall opposite said carriage disc, movable contact means mounted on the rear side of said carriage disc and movable therewith into and out of engagement with said fixed contact means for establishing and breaking an electrical circuit, a first compression coil spring disposed in said enlarged portion and compressed between said insulating rear wall and said insulating carriage disc for biasing said disc and said movable contact means away from said fixed contact means, said spring initially biasing said carriage disc against said shoulder, and a second compression coil spring disposed in said opening and compressed between said push button and said insulating carriage disc for initially biasing said push button in a forward direction and for overcoming the strength of said first compression spring and thereby moving said carriage disc rearwardly to bring said movable contact means into engagement with said fixed contact means when said push button is moved rearwardly in said opening toward said carriage disc.

2. A switch according to claim 1, in which said push button is spaced forwardly from said carriage disc by a distance substantially greater than the length of the front portion of said push button extending forwardly out of said casing, whereby said push button can be pushed rearwardly until it is flush with said casing without causing said push button to encounter any obstruction in said casing.

3. A switch according to claim 1, in which said fixed contact means comprises two electrical contact points on said rear wall, said movable contact means being in the form of a conductive contactor having a loose rockable mounting on said insulating carriage disc to provide for self-alignment of said contactor with said contact points.

* * * * *